United States Patent [19]

Harris et al.

[11] Patent Number: 4,893,852

[45] Date of Patent: Jan. 16, 1990

[54] DUAL SENSOR ELECTROMAGNETIC DOOR LOCK SYSTEM

[75] Inventors: Daniel J. Harris, West Hartford; Richard W. Gladych, Burlington, both of Conn.

[73] Assignee: Harrow Products, Inc., Grand Rapids, Mich.

[21] Appl. No.: 297,700

[22] Filed: Jan. 17, 1989

[51] Int. Cl.[4] ..... E05C 17/56

[52] U.S. Cl. ..... 292/251.5; 49/25; 367/93; 250/342; 292/92

[58] Field of Search ..... 292/251.5; 49/25 X, 49/26; 367/93 X, 138, 95, 61, 150; 340/567; 250/342 X

[56] References Cited

U.S. PATENT DOCUMENTS

| | | | |
|---|---|---|---|
| 3,955,184 | 5/1976 | Cinzori et al. | 340/567 |
| 4,155,066 | 5/1979 | Galvin et al. | 367/93 X |
| 4,551,826 | 11/1985 | Kritz | 367/150 |
| 4,591,864 | 5/1986 | Sternberg et al. | 367/150 X |
| 4,697,383 | 10/1987 | Hagiwara | 49/25 |
| 4,720,128 | 1/1988 | Logan, Jr. et al. | 292/251.5 |
| 4,763,937 | 8/1988 | Sittnick, Jr. et al. | 292/92 |
| 4,800,368 | 1/1989 | Wisner | 340/567 |
| 4,822,085 | 4/1989 | Guity-Mehr | 292/251.5 |

FOREIGN PATENT DOCUMENTS

| | | | |
|---|---|---|---|
| 3344576 | 6/1985 | Fed. Rep. of Germany | 49/25 |

*Primary Examiner*—Gary L. Smith
*Assistant Examiner*—Michael J. Milano
*Attorney, Agent, or Firm*—Chilton, Alix & Van Kirk

[57] ABSTRACT

An electromagnetic lock which mounts at the top of a door frame and magnetically bonds with an armature employs both an ultrasonic sensor and a passive infrared sensor to detect the approach of an individual at the doorway. Both the ultrasonic sensor and the passive infrared detector have fan-shaped sensing regions which are positioned forwardly from the doorway. Upon detection of an individual approaching the doorway, the lock is capable of automatically releasing to allow egress through the doorway.

13 Claims, 3 Drawing Sheets

DUAL SENSOR ELECTROMAGNETIC DOOR LOCK SYSTEM

BACKGROUND OF THE INVENTION

This invention relates generally to a new and improved electromagnetic lock system for providing controlled access through a doorway by means of an electromagnetic lock. More particularly, this invention relates to a lock system wherein controlled access through a doorway is accomplished by means of an automatic electronic sensor system.

Electromagnetic locks which function to magnetically bond a door to the door frame have proved very advantageous in satisfying both security and safety requirements and in providing efficient and reliable means for remote control and monitoring of doorways of a multi-lock system. Electromagnetic locks have effectively eliminated numerous mechanical limitations of the mechanical lock system and have gained widespread popularity. The many additional advantages of electromagnetic lock systems over the conventional mechanical-type lock system, such as centralized control and monitoring, ease of installation and ease of maintenance due to the absence of moving parts are now well established.

In U.S. Pat. No. 4,763,937, entitled "Electromagnetic Door Lock System", an electromagnetic door lock system employs an electromagnetic lock which magnetically bonds with an armature plate. An acoustical transducer generates an ultrasonic detection beam which is directed toward the doorknob. Reflected energy is received and electronically processed to detect the presence of a foreign object such as a hand in the vicinity of the doorknob. The lock automatically deactuates when the foreign object is detected. The electromagnetic lock sensor and processing circuitry are mounted in a housing which is located near the top of a doorway. Electromagnetic locks such as disclosed in U.S. Pat. No. 4,763,937 are adaptable for use in providing controlled access through a multiplicity of stairwell doors in multi-story structures. Such lock systems also incorporate means for controlling authorized egress and for discriminating against unauthorized egress through the doorways. In addition, the electromagnetic locks are adapted for use with a centralized supervisory remote control and remote monitoring to enhance the multi-lock security system and may also be integrated with a smoke detection system.

Although electromagnetic locks such as disclosed in U.S. Pat. No. 4,763,937 reliably operate in an efficient manner under a wide variety of operational conditions, the use of a single detection system, such as an ultrasonic detection system, may under certain conditions, be susceptible to false readings. For example, objects which are mounted off of the floor, may reflect a signal back to the electromagnetic lock receiver in such a form that the processing circuitry is unable to discriminate between the fixed object and that of a human entering the detection zone. Plants, drapes, fire extinguishers etc., under certain conditions are known to produce false detector readings. In addition, certain frequency range noise in close proximity to the lock, such as, for example, noise originating from certain machining processes or air hoses, may cause the lock to release. Crossing traffic in close proximity to the door may also cause the lock to inappropriately automatically release. In addition, cross-talk between closely adjacent locks may result in at least one of the locks releasing.

Accordingly, it is a general aim of the present invention to provide a new and improved electromagnetic lock system which employs a dual sensing system to increase the accuracy and reliability of the automatic locking system and enhance the ability of the system to discriminate between invalid and valid lock release stimuli.

SUMMARY OF THE INVENTION

Briefly stated, the invention in a preferred form is an electromagnetic lock system which employs dual sensors to provide controlled access through a doorway. The system includes a housing which is mounted to the upper portion of the door frame and has an electromagnetic lock which is energizeable for magnetic bonding with an armature mounted to the door. An ultrasonic transducer is mounted in the housing to generate an ultrasonic detection beam of pulse bursts which traverse a path extending downwardly from the housing. The transducer senses reflected echoes from the beam. A passive infrared sensor is also mounted to the housing for sensing radiant energy changes in a detection zone which is located away from the door. The electronic processing circuitry is mounted within the housing to process the received reflected ultrasonic energy for detecting the presence of a foreign object in the beam, and also for processing the sensed radiant energy to detect the movement of a foreign object into the detection zone. Electronic latch means are provided to automatically transform the electromagnetic lock to appropriate energized locked or unlocked states.

The housing includes a pivotally positionable plate having an aperture which cooperates with the ultrasonic transducer to form a generally fan-shaped ultrasonic beam path. The beam path extends at an angle to the plane of the door and generally does not intersect the door hardware. The infrared detection zone is also a generally symmetrically fan-shaped region which extends at an acute angle from the plane of the door. The lock system is also adapted to implement a remote override command to impose either an unlocked or locked status to the electromagnetic lock regardless of the momentary state of detection by the dual sensors.

An object of the invention is to provide a new and improved electromagnetic door lock system which incorporates a dual sensing system.

Another object of the invention is to provide a new and improved electromagnetic door lock system which is relatively easy to maintain and install and operates in a highly efficient manner.

A further object of the invention is to provide a new and improved electromagnetic door lock system having an enhanced means for accurately discriminating between environmental conditions to implement the proper release or locked lock status.

A yet further object of the invention is to provide a new and improved dual sensor electromagnetic lock system which may be efficiently incorporated into an integrated automatic electromagnetic lock and control system.

Other objects and advantages of the invention will become apparent from the drawings and the specification.

DETAILED DESCRIPTION OF THE INVENTION

With reference to the drawings wherein like numerals represent like parts throughout the several figures, a dual sensor electromagnetic door lock system in accordance with the present invention is generally designated by the numeral 10. The dual sensor lock system 10 is readily adaptable for incorporation and for use in connection with a doorway of any number of conventional forms. The lock system is especially adaptable for use with multiple exit stairwell doorways or emergency doorways employed in multi-story or multi-unit structures to provide a security system having centralized remote control and monitoring. The dual sensor electromagnetic door lock system 10 may be readily employed with conventional door latch hardware.

Figure 1:
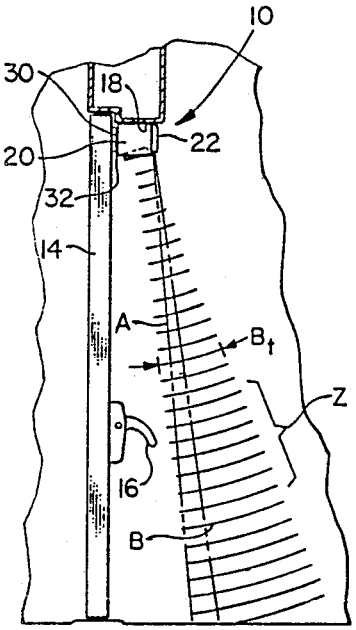
FIG. 1 is a fragmentary side view, partly in schematic, of a dual sensor electromagnetic door lock system of the present invention said system being mounted to a doorway.
Figure 2:
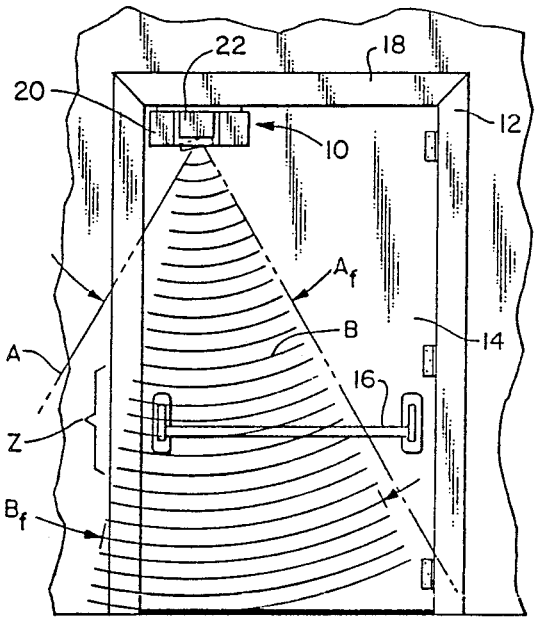
FIG. 2 is a front view, partly in schematic, of the door lock system and doorway of FIG. 1.

With reference to FIGS. 1 and 2, a door frame 12 mounts a door 14 which opens (toward the left in FIG. 1) to provide egress from an interior secured area. Access to the secured area via the door is restricted by the electromagnetic door lock system 10. Standard egress latch hardware which may be in the form of a panic bar 16 for actuating the latch as illustrated, a doorknob (not illustrated) or other conventional form is employed for latching the door in the closed position. The dual sensor door lock system 10 is not limited to the type of doorway illustrated in the drawing or the specific mounting configuration, but is readily adaptable for use with a wide spectrum of door configurations and applications.

Figure 5:
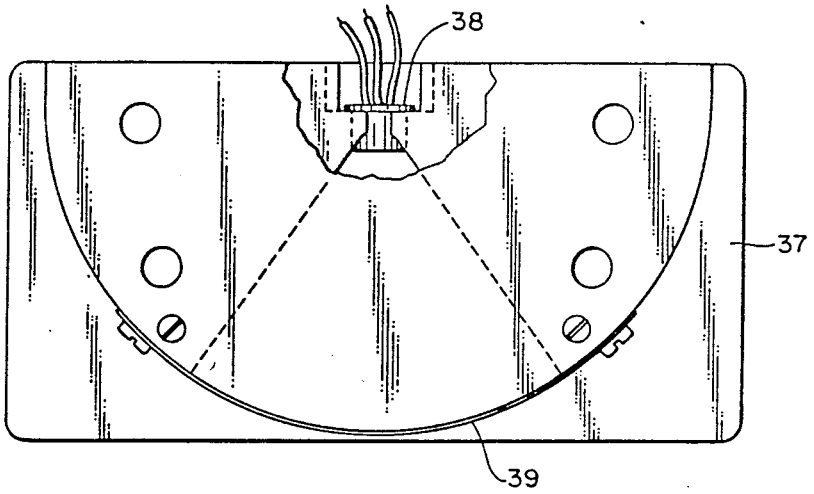
FIG. 5 is an enlarged interior fragmentary view of a portion of the lock system of FIG. 1 illustrating the mounting of one of th sensors.

The dual sensor door lock system 10 employs a tamper resistant housing 20 which compactly houses the electromagnetic lock and the system components including the electronic control system illustrated in FIG. 5. Preferably, the lock system electrically communicates with a centralized remote supervisory control and monitor station (not illustrated). The housing 20 is generally of an elongated rectangular form having a rugged and durable structure and presenting a pleasing external appearance. The housing 20 is mounted to the underside jamb 18 of the door frame so as to extend in a horizontal orientation. The housing 20 is located at one side of the jamb above the inside of the doorway.

In preferred form, the top of the housing forms a longitudinally extending slot (not illustrated) defined between a pair of spaced inclined edges. A base plate (not illustrated) which is dimensioned for close sliding reception in the slot includes complementary edges which mate with the housing slot edges to provide an interlocking engagement. The base plate may be mounted against the jamb 18 by screws or other conventional fasteners. The housing 20 preferably slides onto the base plate in a dovetail-type mounting engagement. Openings in the base plate accommodate the mounting screws or fasteners. It should be appreciated that the described mounting configuration may be accomplished without exteriorly visible mounting fasteners.

The rear of the housing mounts an exteriorly facing electromagnetic element 30 which mates with the closely aligned armature plate 32 mounted to the door. Upon electrical energization of the electromagnetic element, the armature plate 32 is electromagnetically bonded to the electromagnetic element, hence locking the door. The electromagnetic element 30 and the armature plate 32 have complementary contact surfaces and function in a generally conventional fashion. The armature plate and the electromagnetic element are preferably positioned so that they generally align and are in mutual surface-to-surface contact when the door is in the closed latched position. In the doorway configuration illustrated in FIG. 1, the door opens outwardly (to the left) for egress. Access through the doorway to the secured area is restricted while egress from the interior secured area is automatically controlled and monitored as further detailed below.

The electromagnetic lock system 10 incorporates a number of features of the electromagnetic lock system disclosed in U.S. Pat. No. 4,763,937 which patent is incorporated herein by reference.

The electromagnetic lock system 10 is a dual sensing system which detects foreign objects such as an individual in the vicinity of the doorway via a passive infrared (PIR) detection curtain A in addition to an ultrasonic detection beam B. The (PIR) curtain A and the ultrasonic beam B are directed downwardly from the bottom of the housing 20 and intersect the traffic path leading to the doorway. In preferred form, the primary detector is an ultrasonic transducer/receiver which generates a fan-shaped ultrasonic beam B. The beam B is electronically coupled to electronic circuitry as described hereinafter to define a detection zone Z. Zone Z in a preferred configuration ends approximately twenty inches from the level of the floor and spans approximately two-thirds of the door at the height of the panic bar or the latching hardware. Zone Z is spaced from the plane of the door so as not to intersect the latch hardware.

When an individual approaches the doorway and attempts to exit through the doorway by actuating the mechanical door latch in conventional fashion, the electromagnetic lock system 10 automatically senses such a lock releasing condition through curtain A and beam B to automatically release the electromagnetic lock (a time delay may be imposed) without requiring an auxiliary exit switch or other manual switches or releases. A request to exit detector may also be integrated into the dual sensor system. The electromagnetic lock which ordinarily is configured to generate approximately 1,000 to 1,500 pounds of holding force, is also adaptable to automatically release when interfaced with an approved fire control panel (not illustrated) regardless of any pressure which may be applied to the door. The conventional mechanical exit hardware will remain latched to prevent migration of smoke, fire or water and yet allow for ready access by emergency personnel. The electromagnetic lock system 10 is sufficiently sophisticated that it will not release merely when foreign objects are introduced under the door, yet will reliably release for handicapped or disabled individuals who may exit without any special knowledge or effort in operating the lock system.

With additional reference to FIG. 1 and 2, the primary detector is an ultrasonic transmitter/receiver 36 in the form of a transducer which is located at the lock housing interior to emit pulse bursts of ultrasonic energy downwardly through the housing bottom panel. The transducer 36 is equidistantly spaced from the housing ends. Echoes of reflected energy from the ultrasonic beam B are collected and processed by the receiver circuitry.

Figure 3:
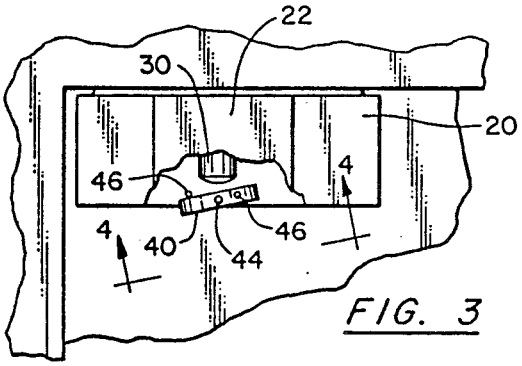
FIG. 3 is an enlarged fragmentary view, partly broken away, of the door lock system and doorway of FIG. 1.
Figure 4:
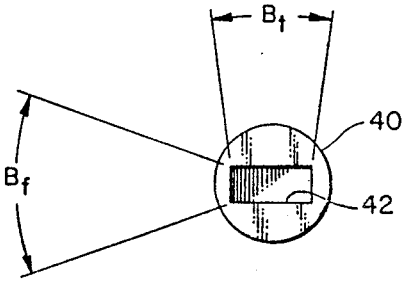
FIG. 4 is an enlarged view of a portion of the lock system of FIG. 3 viewed from the indicated plane 4—4 thereof.

In a preferred configuration, the ultrasonic beam B is a fan-shaped beam which subtends a transverse angle $B_t$ of approximately 15° from the plane of the door (FIG. 1) and subtends a frontal angle $B_f$ of approximately 40° (FIG. 2). The fan-shaped configuration of the beam B is in part governed by a pivoting plate 40 which defines the ultrasonic aperture 42, as best illustrated in FIGS. 3 and 4. The narrow dimension of the aperture 42 results in a corresponding greater angular width $B_f$ compared to angle $B_t$ which is imposed by the long aperture dimension. The plate 40 is pivotally mounted to the housing by pin 44 so that the plate is generally universally positionable. The described housing/transducer configuration is thus applicable for both left- and right-handed doors. The position of the plate is fixed by screws 46 which thread against the plate. The rectangular-shaped aperture 42 is dimensioned to define the fan-shape of the ultrasonic beam. Beam B is directed generally away from the panic bar 16 or other hardware of the door. The rectangular aperture 42 combined with the round transducer, which generates the ultrasonic beam, functions to define the impulse and reception sensitivity of the beam B. The recessed pivoting aperture plate 40 allows for the electromagnetic door system to be relatively easily adjusted for a given application including the specific latch hardware. The ultrasonic sensor essentially functions as a presence detector.

The passive infrared (PIR) sensor 38, which forms a viewing curtain A, functions as a motion detector which is responsive to local changes in temperature. The housing includes a central frontal canopy 22 for housing the PIR sensor 38. The PIR sensor 38 is a wafer-like crystal of pyroelectric material which momentarily generates a small voltage when the radiation impinging on the crystal changes approximately 4° F. The sensor 38 is seated in fixed position in a molded lens support 37 as illustrated in FIG. 5. The lens support 37 is fixed to the housing. A lens 39 covers an opening of approximately 70°.

As illustrated in FIG. 1, the curtain A and the ultrasonic beam B are transversely spaced as they originate from the housing 20. The PIR curtain A preferably subtends an angle which is spaced approximately 5° from the door and has a transverse width of approximately three inches along the floor for a conventional door height. The PIR curtain A subtends a frontal angle $A_f$ on the order of 60° (FIG. 2) so as to span substantially the entire threshold of the doorway. The PIR sensor 38 looks at the floor and essentially registers the floor temperature. An object moving through the curtain A which has a temperature differential of approximately 4° relative to the floor temperature (hotter or cooler) will result in a positive detection. All of the angles may be varied to accommodate the requirements of a given application.

While in the preferred embodiment, both the PIR sensor 38 and the ultrasonic sensor 36 are integrated into a single-housing module, the ultrasonic sensor and the PIR sensor may be operated individually and independently. In the preferred operational mode, the PIR and the ultrasonic sensors are operated in conjunction with one another to provide a safety backup for conditions wherein one sensor may sense false lock release stimuli.

Each sensor may be prone to false readings for certain conditions. For example, the ultrasonic sensor may be adversely affected by objects in the detection zone which are mounted above the floor, such as, plants, drapes, fire extinguishers, and electrical panels. Noises in certain frequency ranges in close proximity to the lock, such as produced by machining or air hoses, may result in a false detection by the ultrasonic sensor 36. Crossing traffic very close to the door may cause the lock to improperly release. In addition, for pairs of doors, certain "cross talk" between locks may cause one or both the locks to release.

The PIR sensor 38 is ordinarily the secondary detector and functions as a motion detector. The PIR sensor 38 may be adversely affected by objects near the entrance and its detection efficiency or reliability is particularly undermined by heated backgrounds such as, for example, sunlight shining through a glass door warming the floor, under-floor heating units, hot air registers and heated vestibules. In addition, the wearing of very heavy clothing may shield the body heat to impair detection by the PIR detector. Push carts, carriers and the like having temperatures substantially equal to the background temperatures may also enter the PIR curtain ahead of the exiting individual and not allow the individual to be initially detected.

Figure 6:
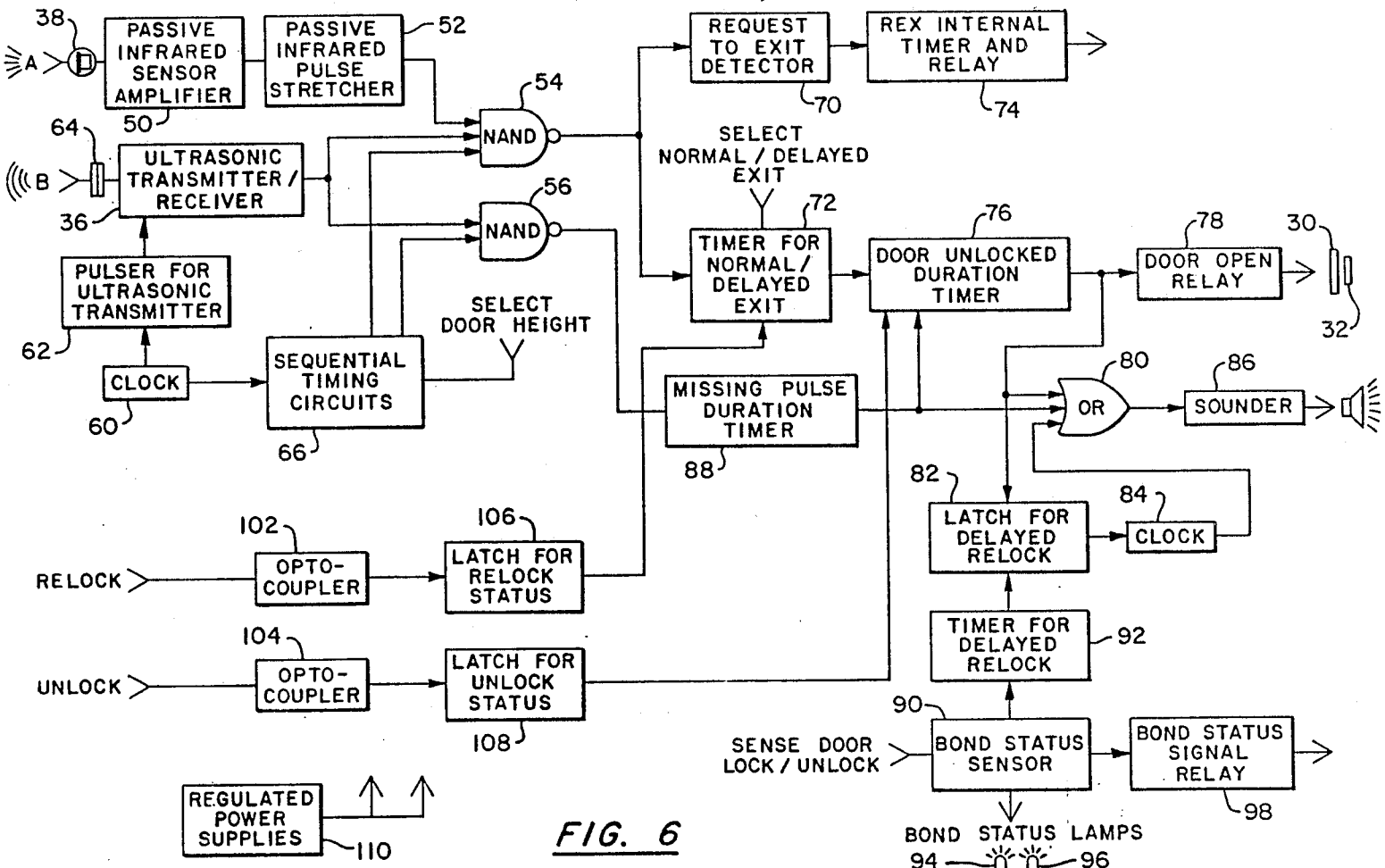
FIG. 6 is a general functional block diagram of the electromagnetic door lock system of FIG. 1.

The overall operation of the dual sensor electromagnetic lock system 10 may best be appreciated by reference to FIG. 6. The infrared energy received from curtain A is detected by the PIR sensor 38. Upon a change in the temperature, a small voltage is momentarily generated by the sensor 38. The voltage signal is applied to the PIR sensor amplifier circuit 50. The amplifier circuit 50 amplifies the voltage signal and applies the amplified signal to the trigger of a PIR pulse stretcher 52. The PIR pulse stretcher 52 generates an output which is applied via an on/off switch to NAND gate 54.

A clock 60, which may be a hex Schmidt inverter, generates an output frequency which is applied to counters of a pulser 62 for the ultrasonic transmitter to synthesize a transmitted ultrasonic wave form. The ultrasonic wave form is amplified and applied to the primary windings of a transformer to step up the voltage for driving the ultrasonic transducer 64. Zener diodes regulate the voltage applied to the transducer 64 and rectify some of the energy charging a capacitor so that the acoustic wave form generated by the transducer 64 comprises a train of pulses which function as a signature to identify reflected energy. The charge voltage is applied across the transducer so that the transducer 64 operates in addition as an electrostatic sensor for sensing acoustic signatures or reflected energy in the path of the ultrasonic energy beam B emanating from the transducer 64.

The returned energy signatures are amplified in the transmitter/receiver circuit 36 to a voltage level which is sufficient for digital processing of the sensitive acoustic signals. The voltage level applied to the operational amplifier is regulated during the time when the transducer is transmitting a pulse to thereby prevent damage to the amplifier. The amplified signal is applied to an amplifier which squares the signal to a form suitable for digital processing. The output signal from the receiver 64 is also applied via an on/off switch to NANDgate 54. The receiver 64 output signal is also applied to NANDgate 56.

Sequential timing circuits 66 are also driven by the clock 60 and are time related to the generated acoustic signals to define the detection zone Z. A door height select switch forms an input to the sequential timing circuits 66 to select the door height, for example, nine feet or seven feet. The output of the timing circuit 66 is also applied to NANDgate 54 so that the output of NANDgate 54 reflects a verified sensing by the PIR sensor 38 and the ultrasonic receiver 36 and the received echo has a correct relationship with the detection zone Z. It should be appreciated that the on/off switches are interposed so that either the passive PIR sensor 38 or the ultrasonic receiver 36 may be individually operated for a given application.

The output signal from NANDgate 54 is applied to a request to exit detector 70 and to a timer 72. The request to exit detector 70 also applies an output signal to an internal timer and relay 74 for remote transmission of the request to exit signal which may typically be applied to an alarm shunt.

A selector switch may be employed to select the normal or delayed exit mode. The selected mode constitutes an input to timer 72. When the timer 72 times out, a door unlocked duration timer 76 is actuated, and a door open relay 78 is latched to release the electromagnetic lock by essentially removing power to the electromagnetic element 30. The output signal for timer 76 is applied to an ORgate 80 and a latch 82 to implement a delayed relocking of the electromagnetic lock. The latch generates a signal which starts a one hertz clock 84. Clock 84 generates a signal which is also applied to the ORgate 80. The output signal from ORgate 80 activates a sounder 86. The sounder 86 generates an intermittent acoustical alarm signal indicative of the open or lock release condition of the door. When all the input signals to ORgate 80 go to a low state, the door relocks and the acoustical alarm from sounder 86 ceases.

The output signals from the sequential timing circuits 66 and the ultrasonic receiver 36 are also applied to a NANDgate 56 which connects with a missing pulse duration timer 88. The missing pulse duration timer 88 functions to essentially verify that the ultrasonic transmitter/receiver 36 is properly operating. The door open relay 78 and the sounder 86 are activated by the missing pulse duration timer 88 to automatically release the lock and sound an alarm.

A lock bond sensor 90, which may be in the form of a Hall Effect sensor, is located within the magnet structure 30 to monitor the strength of the magnetic bond between the magnet 30 and the armature 32 If the magnetic field strength is reduced below a pre-established minimum level, the bond sensor changes state, and consequently transmits an appropriate signal to the bond status signal relay 98. The bond status signal relay provides a remote indication of the status of the magnetic bond. In addition, the bond status signal is sent to the latch for delayed relock timer 92. If the magnetic bond strength does not exceed the preestablished minimum bond strength within a few seconds after the door unlocked duration timer 76 has timed out, the sounder 86 will be caused to emit a warning signal until the bond strength is restored. In addition, the sensor 90 may selectively actuate LEDs 94 and 96 indicating the bond status of the door at the housing.

Opto-couplers 102 and 104 may be employed to couple remote relock and unlock commands from a remote location, such as a central guard station (not illustrated), with the sensing and processing circuitry to override the local dual sensor responsive status of the electromagnetic lock. The opto-couplers function to reduce the possibility that externally generated electronic noise will enter the circuitry and create a false operation. The opto-coupler 102 communicates with a latch 106 which imposes an override relock status (except when the lock is in the delayed mode). The output signal from latch 106 is applied to reset the timer 72. The opto-coupler 104 communicates with a latch 108 which imposes an override unlock status. The output signal from latch 108 is applied via the door unlocked duration timer 76 to activate the door open relay 78 to release the lock.

A power supply 110 provides a regulated power supply for the lock system. In preferred form, the regulated power supply 110 generates a constant voltage for driving the ultrasonic transmitter 36 and the processing circuitry.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electromagnetic lock system adaptable for providing controlled access through a doorway having a frame mounting a door with an armature comprising:

housing means mountable to the door frame;

electromagnetic lock means mounted to said housing means and selectively electrically energizeable for magnetically bonding with the armature to provide a locked state;

ultrasonic sensor means mounted in said housing means for generating an ultrasonic detection beam traversing a path remote from said housing and for receiving reflected echoes from said beam;

passive infrared sensor means mounted in said housing means for sensing radiant energy temperature changes from a detection zone remote from said housing means;

processing means mounted in said housing means for processing said received reflected echoes to detect the presence of a foreign object in said beam and for processing said sensed radiant energy to detect the movement of a foreign object into the detection zone; and lock release means responsive to said processing means for automatically transforming said electromagnetic lock means to a non-locked state for a pre-established time interval upon detection of a foreign object in said beam and movement of the object into said detection zone.

2. The electromagnetic lock system of claim 1 wherein said housing means further comprises a pivotally positionable plate defining an aperture, said ultrasonic sensor means being positioned so that the shape of said beam is at least partly a function of the shape of said aperture.

3. The electromagnetic lock system of claim 2 wherein said ultrasonic sensor means comprises an acoustic transducer having a rounded transmission surface and said aperture has a rectangular shape.

4. The electromagnetic lock system of claim 1 wherein said beam traverses a generally fan-shaped path.

5. The electromagnetic lock system of claim 4 wherein the door has hardware for latching the door in the closed position and further comprising directional means for directionally orienting said beam so that the beam path extends at an angle to the plane of the door and the beams do not intersect said hardware when the housing means is mounted to the door frame generally above the hardware.

6. The electromagnetic lock system of claim 1 wherein said detection zone is a thin generally symmetrical fan-shaped region having a pre-established fixed directional relationship with said housing means.

7. The electromagnetic lock system of claim 1 wherein said ultrasonic sensor means comprises a transducer and said passive infrared sensor means comprises a pyroelectric element, said transducer and element being transversely spaced and positioned generally equidistantly from opposing ends of said housing means.

8. The electromagnetic lock system of claim 1 further comprising remote control unlock command means for selectively controlling the status of said electromagnetic lock means, said lock release means being responsive to said unlock command means for automatically transforming said electromagnetic lock means to a non-locked state.

9. The electromagnetic lock system of claim 1 further comprising latch relock means for automatically transforming said electromagnetic lock means to an energized locked state after a pre-established time interval.

10. The electromagnetic lock system of claim 1 further comprising remote control relock command means for selectively controlling the status of said electromagnetic lock means, said electromagnetic lock means being responsive to said relock command means to automatically transform said electromagnetic lock means to an energized locked state.

11. The electromagnetic lock system of claim 1 further comprising detector means responsive to said processing means for automatically detecting a request to exit the doorway and for transmitting a signal indicative of the request for reception remote from the housing means.

12. An electromagnetic lock system comprising:

doorway means comprising a frame mounting a door, said door having projecting door latch actuating means and an armature:

housing means mounted to the door frame generally above said door latch actuating means;

electromagnetic lock means mounted to said housing and selectively electrically energizeable for magnetically bonding with the armature to lock the door;

ultrasonic sensor means mounted in said housing means including positioning means for generating an ultrasonic detection beam traversing a path remote from said housing and generally downwardly therefrom at an angle to the plane of the door so as not to intersect said latch actuating means and for receiving reflected energy from said detection beam;

passive infrared means mounted in said housing means for sensing radiant energy temperature changes from a detection zone remote from said housing means and generally downwardly therefrom;

electronic processing means mounted in said housing means for processing received reflected energy to detect the presence of a foreign object in said beam and for processing sensed radiant energy to detect the movement of the foreign object into the detection zone; and lock release means responsive to said processing means to automatically transform said electromagnetic lock means to an unlock state for a pre-established time interval when an individual approaches the door and intersects the detection beam and the detection zone.

13. The electromagnetic lock system of claim 11 wherein said doorway means defines a traffic path leading to the door, and said beam and said detection zone are generally fan-shaped and are generally interposed across the traffic path and forwardly spaced from the door.

* * * * *